United States Patent [19]

Allman et al.

[11] 3,934,789

[45] Jan. 27, 1976

[54] MEAT SPACER TRAY

[75] Inventors: Richard L. Allman, Seymour, Ind.; Vernon E. Meurer, Fullerton, Calif.

[73] Assignee: Standard Oil Company, Chicago, Ill.

[22] Filed: Dec. 19, 1974

[21] Appl. No.: 534,569

[52] U.S. Cl. ..... 229/2.5; 220/66; 206/518; 217/26.5; 34/238

[51] Int. Cl.[2] ..... B65D 1/00

[58] Field of Search ..... 34/237, 238; 220/66; 217/26.5; 229/2.5; 206/503, 518

[56] References Cited

UNITED STATES PATENTS

| | | | |
|---|---|---|---|
| 2,715,284 | 8/1955 | Molina | 34/238 |
| 3,392,875 | 7/1968 | Bockenstette | 220/66 X |
| 3,494,502 | 2/1970 | Roush et al. | 220/66 |
| 3,591,032 | 7/1971 | Baxter | 229/2.5 |
| 3,698,623 | 10/1972 | Bixler | 229/2.5 |
| 3,732,976 | 5/1973 | Bessett | 229/2.5 X |
| 3,751,852 | 8/1973 | Schrepper | 229/2.5 X |
| 3,794,208 | 2/1974 | Roush | 206/518 X |

*Primary Examiner*—Davis T. Moorhead
*Attorney, Agent, or Firm*—Robert R. Cochran; Arthur G. Gilkes; William T. McClain

[57] ABSTRACT

A meat spacer tray of molded plastic for freezing and storing meat is disclosed wherein an open array of holes, ribs, and connectors permit free circulation of air around meats placed thereon and, also, will hold odd-shaped cuts of meat such as hams.

8 Claims, 4 Drawing Figures

MEAT SPACER TRAY

BACKGROUND OF THE INVENTION

The quick freezing of meat process is aided by the disclosed device. Presently, most meat processing plants are using either a wooden spacer or a stainless steel spacer. Several disadvantages are encountered in these present methods:

1. The cleaning of a wooden spacer is both a difficult and time-consuming job;
2. Wood has a tendency to splinter and absorb water; and
3. The cost of stainless steel is much greater than the disclosed and instantly claimed invention.

BRIEF SUMMARY OF THE INVENTION

A meat spacer tray of molded plastic for freezing and storing meat is disclosed wherein an open array of holes, ribs, and connectors permit free circulation of air around meats placed thereon and also will hold odd-shaped cuts of meat such as hams.

It is an object of this device to be easily cleanable.

It is an object of this device to be nestable for ease of storage when not in use.

It is an object of this device to avoid crevices which will afford sites for the undesirable growth of bacteria.

It is an object of this device to have both a one piece construction and a non-porous surface.

It is an object of this device to be steam cleanable and also withstand low temperatures of about −60°F.

It is an object of this device to promote efficient air flow to aid rapid and uniform freezing.

Other objects and advantages of our invention will be apparent to those skilled in the art upon reading this specification.

BRIEF DESCRIPTION OF THE INVENTION

The meat freezing spacer and tray of molded plastic is disclosed in FIGS. 1–4.

DETAILED DESCRIPTION OF THE INVENTION

Our invention consists of a meat spacer tray of molded plastic. The tray has been specifically designed to facilitate uniform and rapid freezing of meat by permitting the passage of air around meat placed between two meat spacer trays. In its simplest form our meat spacer tray consists of the following basic elements: top planar rectangular members [FIG. 1, 1–6], bottom rectangular planar members [FIG. 1, 7–11], and connecting means [FIG. 1, 12–22] to hold the top and bottom planar rectangular members in fixed positions with respect to one another. To the previously described basic structure are added the following elements which impart additional strength and stability to the meat spacer tray, i.e., flanges [FIG. 3, 23] and ribs [FIG. 1, 24–25]. The top rectangular planar members [FIG. 3, 1–2] have their longer sides extending in the longitudinal direction of the spacer and each of said members top and bottom rectangular planar surfaces are coplanar to one and another, respectively. The top [FIG. 3, 37] and bottom [FIG. 3, 53] surfaces of one said member [FIG. 3, 1] being coplanar to the corresponding surfaces [FIG. 3, 38 and 30] of other said members [FIG. 3, 2]. There are two types of top planar members. The first said top type [FIG. 1, 2–5] has two rows of square holes [FIG. 1, 26] extending between said types' top and bottom surfaces wherein said square holes have rounded corners [FIG. 2, 27], the top edges of said square holes being rounded [FIG. 3, 28] and the side surfaces [FIG. 3, 29] of said square holes are normal to the bottom surfaces [FIG. 3, 30] of said top members. The second said top type has a single row of rectangular holes [FIG. 2, 31] extending between said types' top and bottom surfaces wherein the longer sides of the said rectangular holes are parallel to said longitudinal direction of the spacer. The two top outside rectangular planar members [FIG. 1, 1 and 6] having their longer sides in the longitudinal direction of said spacer each have a single row of said rectangular holes [FIG. 2, 31]. The remaining top planar rectangular members, all have at least one row of square holes. It is to be noted that the invention is not intended to be limited to any particular kind of holes in either the top or bottom planar members, nor should the invention be limited to holes which have particular rounded surfaces or normal sides to the surfaces of either the top or bottom planar rectangular members.

Figure 3:
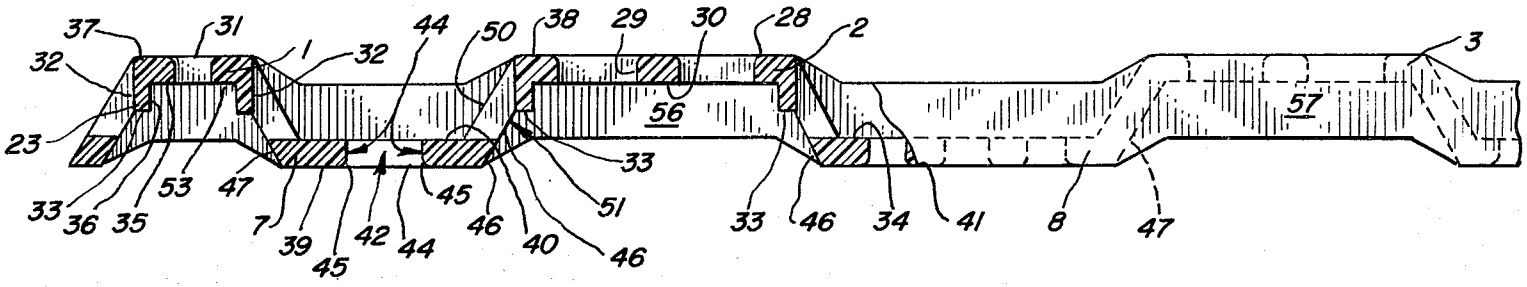
FIG. 3 is an enlarged cross-section side elevation view of the meat spacer tray of molded plastic along the line 3—3 as shown in FIG. 1.
Figure 4:
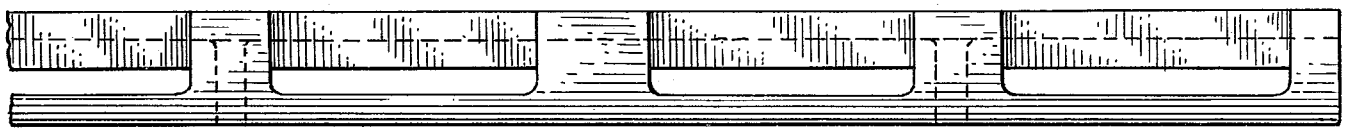
FIG. 4 is a front elevation view of the meat spacer tray of molded plastic along line 4—4 in the direction of the arrow as shown in FIG. 2.

There are two flanges [FIG. 3, 23] attached to the bottom horizontal rectangular surface [FIG. 3, 30] along both longitudinal edges of all top rectangular planar members. The sides of said flanges [FIG. 3, 32] extend downward from the top planar member so that the bottom surface [FIG. 3, 33] of each said flange is spaced above the top planar surface [FIG. 3, 34] of the hereinafter recited adjacent bottom rectangular members [FIG. 1, 7–11]. These flanges are intended as structural pieces to strengthen the overall meat spacer tray. One vertical surface [FIG. 3, 36] of said flange and the bottom said surface [FIG. 3, 35] of the top planar member forms a right angle and the other vertical surface [FIG. 3, 32] of said flange is continuous with and coplanar to a vertical longitudinal side [FIG. 3, 32] of said top rectangular member. Said other vertical surface of said flange forms a right angle between said vertical longitudinal side [FIG. 3, 32] and the top rectangular planar surface [FIG. 3, 37] of said top planar member [FIG. 3, 1].

There are bottom rectangular members [FIG. 1, 7–11] which have their longer sides extending longitudinally and each of said members top [FIG. 3, 34 and 40] and bottom rectangular planar surfaces [FIG. 3, 39 and 41] are coplanar to one another respectively. That is, the top [FIG. 3, 40] and bottom [FIG. 3, 39] surfaces of one said member [FIG. 3, 7] are coplanar to the corresponding surfaces [FIG. 3, 34 and 41] of other said members [FIG. 3, 8]. These said members are of two types. The first said type [FIG. 1, 7 and 11] of bottom rectangular planar members has a single row of square holes [FIG. 3, 42] extending between the top [FIG. 3, 40] and bottom [FIG. 3, 39] horizontal rectangular surfaces of said member [FIG. 3, 7]. These holes have rounded [FIG. 2, 43] corners. The side surfaces [FIG. 3, 44] of said holes are normal to the top surfaces [FIG. 3, 40] of said members. The bottom edges [FIG. 3, 45] of said holes are rounded. The second said type

[FIG. 1, 8–10] of bottom rectangular planar member has two rows of square holes extending between the top and bottom horizontal rectangular surfaces of said member. The said square holes have rounded corners. The side surfaces of said square holes are at right angles to the top surfaces of said members. The bottom edges of said square holes are rounded. It should be noted that the particular arrangement of holes previously described is but one claimed example in a more general meat spacer tray wherein the exact nature of the holes generally in a vertical direction to the top and bottom surfaces of the planar rectangular members are less defined.

In one embodiment of our meat spacer tray said bottom members have two sloping longitudinally extending sides [FIG. 3, 46 and 47] wherein said sloping longitudinally extending sides are along the two longer edges of said member. They form an angle ranging from 90° to 170° as measured within said member between one said sloping side [FIG. 3, 46] and the bottom rectangular planar surface of a bottom planar member [FIG. 3, 39].

The top and bottom planar rectangular members are positionally related to one another in two ways. The first way is that the outer planar rectangular members [FIG. 1, 1 and 6] are top planar rectangular members having a single row of rectangular holes and positionally adjacent (hereinafter defined) to these said members are two bottom planar rectangular members [FIG. 1, 7 and 11] each having a single row of square holes. The second said way is that positionally adjacent to the two said bottom planar rectangular members [FIG. 1, 7 and 11], wherein each said member has a single row of holes, are two top rectangular [FIG. 1, 2 and 5] members each having two rows of square holes. Positionally adjacent to said top planar members [FIG. 1, 2 and 5] are two bottom planar members [FIG. 1, 8 and 10]. Said top [FIG. 1, 2–5] and said bottom [FIG. 1, 8–10] planar members alternate with one another so that between each bottom planar member is a top planar member except for the two outside top planar members [FIG. 1, 1 and 6]. The top planar members on the outside have at least one row of rectangular holes [FIG. 3, 31]. The direction of the longer sides of said rectangular holes is in the longitudinal direction. The overall arrangement of top and bottom rectangular planar members is such that between two top planar rectangular members there will always be a bottom planar rectangular member. Again it is noted for emphasis that the invention should not and is not intended to be limited to the particular type and arrangement of holes penetrating the top and bottom surfaces of the planar rectangular members.

Figure 1:
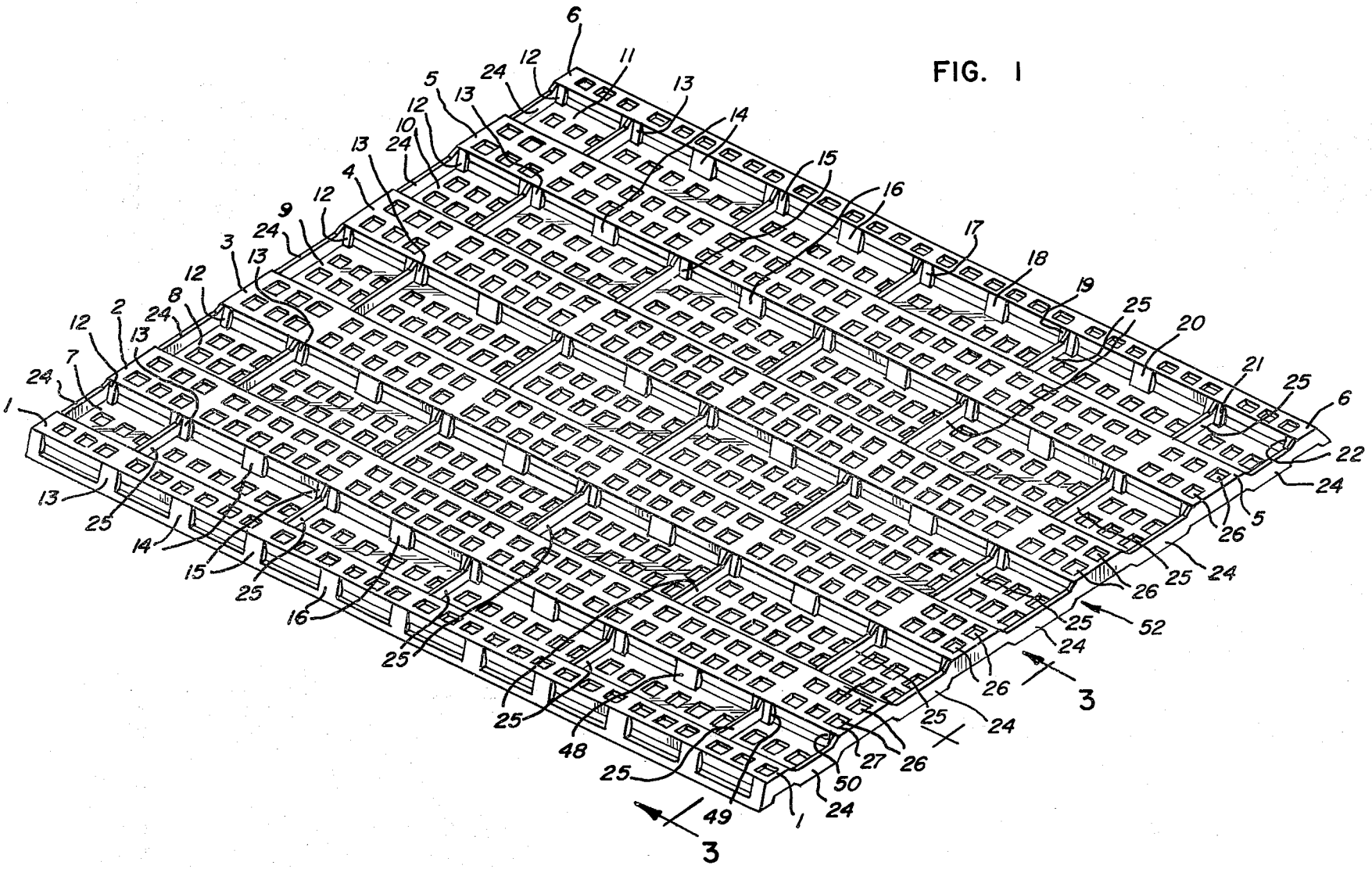
FIG. 1 is a top perspective view of the meat spacer tray of molded plastic.
Figure 2:
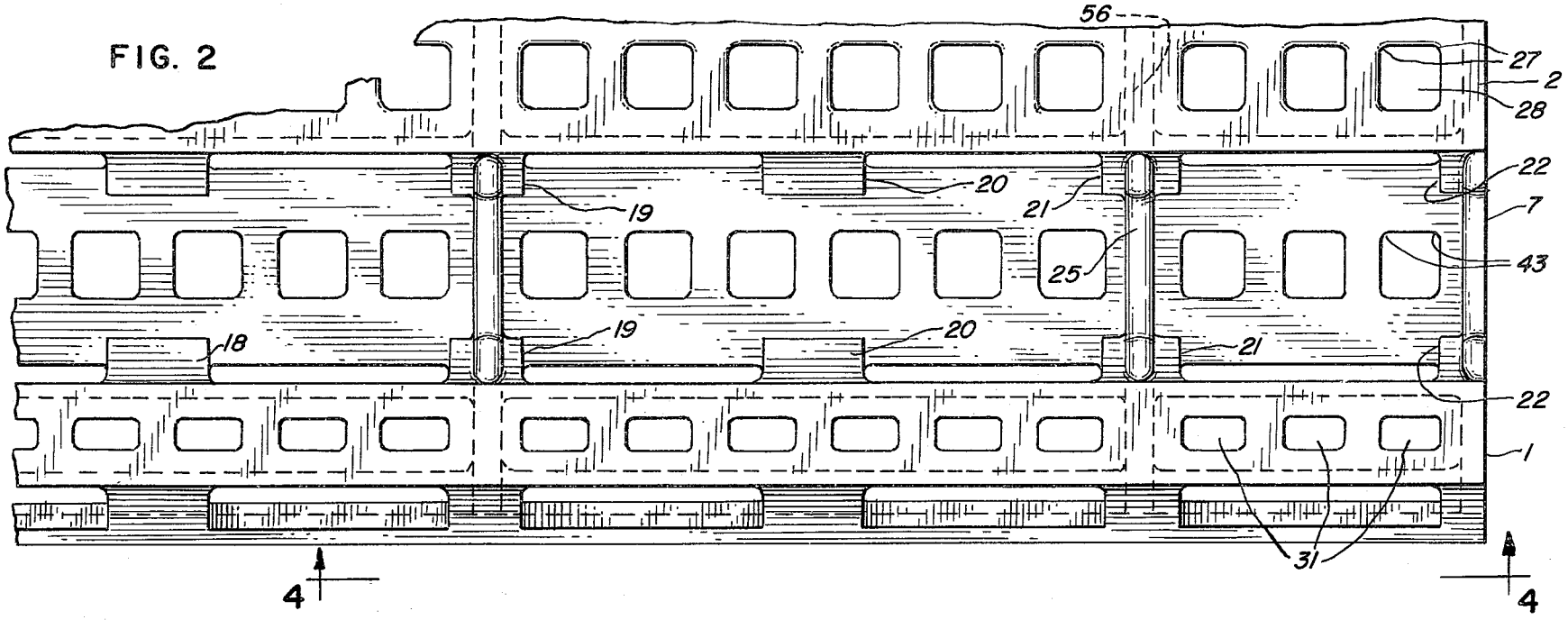
FIG. 2 is an enlarged top plan view of the bottom corner section of the meat spacer tray of molded plastic as shown in FIG. 1.

Positions of planar members adjacent to one another mean the two positions occupied by a top planar member [FIG. 1, 2] and one of its nearest neighbors, a bottom planar member [FIG. 1, 7 or 8] and vice versa, wherein if one were to imagine that a top planar member [FIG. 1, 2] were to be moved down vertically and then moved horizontally in a direction perpendicular to said members longer side, then said "moved" member would occupy the same position as said member's nearest neighbor, a bottom planar member [FIG. 1, 7 or 8] and similarly if one were to imagine a bottom planar member [FIG. 1, 7] moved upward vertically and then horizontally in a direction perpendicular to said members longer edge then said "moved" member would occupy the same position as said members nearest neighbor, a top planar member [FIG. 1, 1 or 2].

Connecting means are provided to hold the top and bottom planar rectangular members in a fixed position with respect to one another. Examples of said connecting means are connectors [FIG. 1, 12–22] and/or transverse ribs [FIG. 1, 25]. One suitable shape of these connectors is a frustum. For purposes of illustration the connectors will be referred to as frustum connectors. A plurality of spaced apart frustum connectors [FIG. 1, 12–22] extend between bottom rectangular planar members and top planar rectangular members. In one specific embodiment of our invention, there are three types of frustum connectors. However, it is to be noted that in a more general structure, the type and shape of particular connectors need not be so limited. The first said type of frustum connector [FIG. 1, 12 and 22] is at each end of every bottom rectangular planar member. The second said type [FIG. 1, 13, 15, 17, 19 and 21] is spaced inward toward the center of the meat spacer tray in the longitudinal direction from the first said type and is connected along the longitudinal edge of said bottom planar rectangular member. The third type [FIG. 1, 14, 16, 18, and 20] is spaced inward toward the center of the meat spacer tray in the longitudinal direction from the said second type and this third said type alternates with the second said type along both longitudinal top edges of the bottom planar member. All frustum connectors of types one, two or three connect the top surface [FIG. 3, 40] of said bottom planar members to the side [FIG. 3, 32] and flange [FIG. 3, 23] of the nearest (adjacent) top planar member [FIG. 3, 1 or 2]. The frustum connectors have one side [FIG. 1, 48, 49, and 50] sloping in such a manner as to form an angle between said sloping side of the frustum connector and the top planar surface of the top rectangular planar members. An angle of between 90° and 170° as measured internally is formed between said sloping planar side [FIG. 1, 48, 49 and 50] of said frustum connectors and the top planar surface of the top planar rectangular member. The side [FIG. 3, 51] of said frustum connector opposite the previously described sloping planar side [FIG. 3, 50] is continuous with and coplanar to the sloping sides [FIG. 3, 46] of said bottom rectangular planar member [FIG. 3, 7].

A plurality of rectangular holes are defined by the sides of frustum connectors [FIG. 1, 12–22], the top of the bottom rectangular members and the bottom [FIG. 3, 33] of the downwardly extending flanges. It is to be noted that in the more general structure for this invention there are no flange pieces.

In order to impart strength and stability to our meat spacer or as connecting means to hold top and bottom planar members in fixed positions with respect to one another, there are included a plurality of ribs [FIG. 1, 24 and 25]. Said ribs traverse the longitudinal direction of the bottom planar members. These ribs are of two types. The first type [FIG. 1, 24 and 25] is attached to the top surfaces of bottom planar members wherein said first type forms inner [FIG. 1, 25] and outer [FIG. 1, 24] ribs. The outer said ribs [FIG. 1, 24] have three fused surfaces. The first said fused surface is between the bottom surface of each said rib and the top surface of each bottom planar member and the second and third fused surfaces are between the ends of each rib and two frustum connectors [FIG. 1, 12 and 22] of the first type. In one of the specific embodiments, the first type of rib [FIG. 1, 24] used as an outer wall is connected through two fused surfaces to two frustum connectors of the first type [FIG. 1, 12 and 22]. A right angle is formed between the top surface of said bottom planar member and the inner surface of the vertical side of said rib and the outer surface of said rib forms a right angle with the bottom surface of said bottom planar member. The inner ribs [FIG. 1, 25] of this first type have three fused surfaces, the first said fused surface is between the bottom surface of each said rib and the top surface of each said bottom planar member. The second and third fused surface are between the ends of each said rib and frustum connectors [ FIG. 1, 13, 15, 17, 19, and 21] of the second type. In one embodiment of our invention, two right angles are formed between the top surface of the bottom planar member and both vertical wall-like sides of said inner ribs.

The second said type is connected to the bottom surfaces of top planar members wherein said second type forms inner [FIG. 3, 56] and outer [FIG. 3, 57] ribs. Said outer ribs have three fused surfaces: The first said fused surface is between the top surface of each said rib and the bottom surface of the top planar member. The second and third said fused surfaces are between the ends of each said rib and a combination of frustum connectors of the first type and flanges. A right angle is formed between the bottom surface of the said top planar member and the inner surface of the vertical side of said rib. The outer surface of said rib forms a right angle with the top surface of the top planar member so that a continuous coplanar outer surface [FIG. 1, 52] is formed consisting of the surfaces of alternating outer ribs of said first and second types. Said inner ribs [FIG. 3, 56] have three fused surfaces: The first said fused surface is between the top surface of said rib and the bottom surface of the top planar member and the second and third said fused surfaces are between the ends of each said rib and a combination of flange pieces and frustum connectors of the second type. Right angles are formed between the bottom surface of said planar member and the two vertical wall-like surfaces of the said rib so that said vertical surfaces of said rib are coplanar with vertical surfaces of the first type of inner rib. It is to be noted that flange [FIG. 3, 23] described previously can be omitted. Further the overall appearance of the transverse inner ribs of the first and second type when aligned with one another is a continuous wall-like member divided into equal segments by frustum connectors. Said equal segments are inner ribs alternately of the first and second kind.

It should be noted that by having the longitudinal dimension of all frustum connectors (hereinbefore discussed) equal to the longitudinal dimension of all ribs will result in the embodiment that uses only ribs as connecting means. Note that this effect is approached by connectors [FIG. 1, 12 and 22] of the first type because the longitudinal dimension of said connectors are almost the same as the outer ribs [FIG. 1, 24] of the first type.

Our invention of a meat spacer tray also includes a more general embodiment to be described briefly. In the more general form, our meat spacer tray comprises a plurality of top rectangular planar members, a plurality of bottom rectangular planar members and a plurality of connecting means.

The top planar members have the longer sides extending longitudinally and have said members' top and bottom planar surfaces coplanar to one another, respectively. i.e. the top and bottom surfaces of one said member is coplanar to the corresponding surfaces of all other said members.

The bottom rectangular planar members have their longer sides extending longitudinally and have each of their corresponding top and bottom rectangular planar surfaces coplanar to one another respectively the top and bottom surfaces of one said member being coplanar to the corresponding surfaces of other said bottom members. The top and bottom planar members are adjacent to [as hereinbefore defined] one another. The arrangement of top and bottom planar members is such that they alternate with one another so that the next nearest member for top planar members is always one or more bottom planar members and vice versa. Also, in our more general invention, are a plurality of connectors extending between bottom planar members and top planar members to secure the relative positions of each top member with respect to said top member's nearest neighbor, at least one bottom planar member. The width of these connectors may be all of uniform size or they may vary. For example, if the connectors extended the whole length of the longitudinal side of the planar rectangular members then there would be no vertical holes [hereinafter described] but rather a solid wall-like structure. It is to be noted that the advantage of the present invention arises from its ability to permit free circulation of air so that it is a significant feature of our invention to have connectors running along the longitudinal edge of the bottom planar members whose width along the longitudinal edge is smaller than the total width of the longitudinal direction.

A plurality of top and bottom holes which have sides defining an axis in a horizontal direction and in a transverse direction to the longitudinal arise from having connectors which do not totally extend the longitudinal width. A plurality of holes having the following structural members for said holes sides: Sides of connectors transverse to the longitudinal direction, top surfaces and longitudinal side surfaces of the bottom planar members, and the bottom surfaces and longitudinal side surfaces of the top planar members.

In this more general structure, it is possible to incorporate ribs of the first and second type as described earlier to traverse the longitudinal direction of top and bottom planar members and thereby add structural strength to our invention.

The following use and method of manufacture is but one example and should not be unduly limiting. There are many variations on the invention herein disclosed which will be readily apparent to one skilled in the art.

EXAMPLE OF USE

Said meat spacer tray is currently being used in the quick freezing of meats wherein meat either packaged or not is placed upon one meat spacer, followed by a second spacer, which is placed upon said first layer of meat. Several layers of meat are thereby achieved.

It should be noted that the arrangement of meat is such that the meat spacer placed thereon is level.

The temperatures range that a meat spacer would be subject to in freezing varies 10° above 0°F to as much as 60°F below.

EXAMPLE OF METHOD OF MANUFACTURE

One method of manufacturing our meat spacer is given in U.S. Pat. No. 3,268,636 invented by Richard G. Angelli, Jr., filed July 1, 1963. There are a variety of foamable polymeric material indicated such as polyethylene, polypropylene, polystyrene, etc. which may be employed in the fabrication of our meat spacer tray.

We claim:

1. A meat spacer tray comprising:

A. a plurality of top rectangular planar members, said members having their longer sides extending longitudinally and having said members' top and bottom rectangular planar surfaces co-planar to one another respectively, wherein the top and bottom surfaces of one said member are coplanar to the corresponding surfaces of other said members, B. a plurality of bottom rectangular planar members, said members having their longer sides extending longitudinally and having each of said members' top and bottom rectangular planar surfaces coplanar to one another respectively, wherein the top and bottom surfaces of one said member are coplanar to the corresponding surfaces of other said members, and said bottom members are positionally related to the top planar rectangular members in two ways: the first said way is by two distances, one being a vertical distance in a direction normal to said members top planar surfaces giving rise to a space between the bottom surfaces of said top planar members and the top surfaces of said bottom planar members and the other being a horizontal distance in a direction normal to said top members' longer side and the second said way is an alternation of top and bottom rectangular members wherein all top planar members have two nearest neighbors of bottom rectangular planar members and vice versa, except for the two planar recentgular members on the longitudinal outside edges, C. a plurality of connecting means extending between bottom planar members and top planar members to secure the relative position of each top planar member with respect to each bottom planar member positionally adjacent to said top planar member, D. a plurality of holes of at least two types; at least one said type extending between the top and bottom surfaces of top planar rectangular members, and the other said type extending between the top and bottom surfaces of bottom planar rectangular members, E. a plurality of holes, wherein the sides of said holes are the sides of two connecting means, the top surfaces of bottom planar members, and the bottom surfaces of the top planar members.

2. The meat spacer tray of claim 1, wherein there is added a plurality of a first and second type of ribs: the first type is attached to the top surfaces of bottom planar members wherein said first type forms two outer walls, which said outer walls are transverse to the longitudinal direction of said bottom planar rectangular members, the second type is attached to the bottom surfaces of top planar members, so that a continuous and coplanar external outer surface consisting of surfaces from both types of ribs and having the appearance of a uniform outer wall is formed.

3. The meat spacer of claim 2, wherein there is added a plurality of a first, and second type of ribs: the first type is attached to the top surfaces of bottom planar members wherein said first type forms at least one inner rib, said inner rib has a first, second, and third fused surface: the first fused surface is between the bottom surface of said rib and the top surface of at least one bottom planar member, the second and third fused surfaces are between the ends of said rib and two connectors, the second type forms at least one inner rib, said inner rib has a first, second, and third fused surface: the first fused surface is between the top surface of said rib and the bottom surface of at least one top planar member, the second and third fused surfaces are between the ends of said rib and two connectors, wherein the sides of said ribs of the first and second type are colinear with one another and transverse to planar members so as together to form a continuous brace for planar rectan-gular members.

4. A meat spacer tray comprising:

A. a plurality of top rectangular planar members, said members having their longer sides extending longitudinally and having each of said members' top and bottom rectangular planar surfaces co-planar to one another respectively, wherein the top and bottom surfaces of one said member are co-planar to the corresponding surfaces of other said members, which said members are of a first and second type: the first type having two rows of square holes extending between said type's top and bottom surfaces wherein: said square holes have rounded corners, the top edges of said square holes are rounded and the side surfaces of said square holes are normal to the bottom surfaces of said members; the second type having a single row of rectangular holes penetrating said type's top and bottom surfaces wherein the longer sides of said rectangular holes are parallel to said longitudinal direction, B. two flanges being attached to the bottom horizontal rectangular planar surface along both longitudinal edges of each top rectangular planar member wherein: the sides of said flanges extend downward from the top planar member so that the bottom surface of each said flange is spaced above the upper planar surface of the hereinafter recited bottom rectangular planar members and an angle being formed between one vertical surface of said flange and the said surface of the planar member is a right angle, and the other vertical surface of said flange is continuous with and co-planar to a vertical longitudinal side of said rectangular planar member, and forms a right angle between said vertical longitudinal side and the top rectangular planar surface of said top planar member, C. a plurality of bottom rectangular planar members, said members having their longer sides extending longitudinally and having each of said members' top and bottom rectangular planar surfaces co-planar to one another respectively, wherein the top and bottom surfaces of one said member are coplanar to the corresponding surfaces of other said members, which said members are of a first and second type: the first type has a single row of square holes penetrating the top and bottom horizontal rectangular surfaces of said member, wherein: said holes have rounded corners, the side surfaces of said holes are normal to the top surfaces of said members, and the bottom edges of said holes are rounded, and the second type has two rows of square holes penetrating the top and bottom horizontal rectangular surfaces of said member, wherein: said square holes have rounded corners, the side surfaces of said square holes are at right angles to the top surfaces of said members, and the bottom edges of said square holes are rounded; which said members have two sloping longitudinal sides, wherein: said sloping longitudinal sides are along the two longer sides of said member, said side and the bottom surface of said member form an angle between 90° to 150° as measured within said member, and the top and bottom planar rectangular members are positionally related to one another in two ways: the first said way is that the outer planar rectangular members are top planar rectangular members each having a single row of rectangular holes, and in positions positionally adjacent to these said members are two bottom planar rectangular members each having a single row of square holes; the second said way is that in positions positionally adjacent to the two said bottom planar rectangular members each said member having a single row of holes are two top rectangular members each having two rows of square holes wherein positionally adjacent to each said top planar member are two bottom planar members and said top and said bottom planar members, alternate with one another so that between each bottom planar member is a top planar member and vice versa, except for the two outside top planar members each having a single row of rectangular holes, D. a plurality of spaced apart frustum connectors extending between bottom rectangular planar members and top rectangular planar members which said frustum connectors are of a first, second, and third type: the first type is at each end of every bottom rectangular planar member, the second type is spaced inward toward the center of said bottom rectangular planar member in the longitudinal direction from the first type, and the third type is spaced inward toward the center of said bottom rectangular planar member in the longitudinal direction from the second type and this third type alternates with this second type along both longitudinal top edges of the bottom planar member and which said frustum connectors connect the top surface of said bottom planar member to the side and flange of the top planar member in a position positionally adjacent to said bottom planar member, wherein: an angle of 90°–170° as measured internally is formed between a sloping plane of said frustum connectors and the top planar surface of said top rectangular planar member and the side of said frustum connector opposite to the said sloping plane is continuous with and co-planar to a sloping side of said bottom rectangular planar member, E. a plurality of rectangular holes defined by the sides of said frustum connectors, the top surfaces of the bottom rectangular members, and the bottom surfaces of the downwardly extending flanges, F. a plurality of ribs comprising a first and second type: the first type is attached to the top surface of each bottom planar member wherein said first type forms inner and outer ribs, said outer ribs have a first, second, and third fused surface: the first fused surface is between the bottom surface of each said rib and the top surface of each bottom planar member, the second and third fused surfaces are between the ends of each said rib and two frustum connectors of the first type so that a right angle is formed between the top surface of said bottom planar member and said rib's inner vertical surface in the direction toward the center of said bottom planar member and so that said rib's outer surface opposite said inner surface forms a right angle with the bottom surface of said bottom planar member, and said inner ribs have a first, second, and third fused surface: the first fused surface is between the bottom surface of each said rib and the top surface of each said bottom planar member, the second and third fused surfaces are between the ends of each said rib and frustum connectors of the second type so that two right angles are formed between the top surface of the bottom planar member and both vertical wall-like sides of said rib; the second type of rib is connected to the bottom surfaces of top planar members wherein said second type forms inner and outer ribs, said outer ribs have a first, second, and third fused surface: the first fused surface is between the top surface of each said rib and the bottom surface of the top planar member, the second and third fused surfaces are between the ends of each said rib and frustum connectors of the first type so that a right angle is formed between the bottom surface of the said top planar member and said rib's inner vertical surface in the direction toward the center of said top planar member, so that the outer surface of said rib forms a right angle with the top surface of the top planar member and so that a continuous coplanar outer surface is formed consisting of surfaces of alternating outer ribs of said first and said second types, and said inner ribs have a first, second, and third fused surface: the first fused surface is between the top surface of said rib and the bottom surface of a top planar member and the second and third fused surfaces are between the ends of each said rib and a combination of flange pieces and frustum connectors of the second type so that the right angles are formed between the bottom surface of said top planar member and the two vertical wall-like surfaces of the said rib so that said vertical surfaces of said rib are co-planar with vertical surfaces of the first type of inner rib.

5. The meat spacer tray of claim 1 wherein the material used for said meat spacer tray is polyethylene.

6. The meat spacer tray of claim 2 wherein the material used for said meat spacer tray is polyethylene.

7. The meat spacer tray of claim 3 wherein the material used for said meat spacer tray is polyethylene.

8. The meat spacer tray of claim 4 wherein the material used for said meat spacer tray is polyethylene.

* * * * *